US005130217A

United States Patent [19]

Champ et al.

[11] Patent Number: 5,130,217

[45] Date of Patent: Jul. 14, 1992

[54] SQUARYLIUM PHOTOCONDUCTORS WITH NONCRYSTALLINE BISPHENOL A BINDERS

[75] Inventors: Robert B. Champ, Boulder; Donald A. Stremel, Northglenn, both of Colo.

[73] Assignee: Lexmark International, Inc., Greenwich, Conn.

[21] Appl. No.: 761,116

[22] Filed: Sep. 17, 1991

[51] Int. Cl.[5] ..... G03G 5/06; G03G 5/047

[52] U.S. Cl. ..... 430/59; 430/58; 430/96

[58] Field of Search ..... 430/58, 59, 96

[56] References Cited

U.S. PATENT DOCUMENTS 3,396,016 8/1968 Olson ..... 430/96
3,406,063 10/1968 Matkan et al. ..... 430/96 X
3,824,099 7/1974 Champ et al. .
4,123,270 10/1978 Heil et al. .
4,362,798 12/1982 Anderson et al. ..... 430/59
4,490,452 12/1984 Champ et al. ..... 430/58
4,582,772 4/1986 Teuscher et al. ..... 430/58
4,677,045 6/1987 Champ et al. ..... 430/76

*Primary Examiner*—Roland Martin
*Attorney, Agent, or Firm*—John A. Brady

[57] ABSTRACT

An aggregate xerographic photoconductor having light sensitive squarylium dye and a binder for said dye is chosen from a mixture of bisphenol molecules to form a noncrystalline, nonpolymeric product. A layered photoconductor utilizing this generation layer formulation in conjunction with a hole transporting surface layer is described.

10 Claims, No Drawings

SQUARYLIUM PHOTOCONDUCTORS WITH NONCRYSTALLINE BISPHENOL A BINDERS

DESCRIPTION

1. Field of the Invention

This invention relates to the field of organic electrophotographic photoconductors of the type used in reproduction devices such as copiers and printers.

2. Background of the Invention

Squaric acid methine dyes are known compounds and U.S. Pat. No. 3,824,099 describes squarylium dye molecules as photogenerating species in a xerographic photoconductor's charge generation layer. U.S. Pat. 4,123,270 describes the method of making a photoconductor using the squarylium dyes dissolved in amine solvents. U.S. Pat. 3,396,016 discusses the use of molecular binders such as the bisphenol class for dispersed inorganic piqment photoconductors, such as zinc oxide. U.S. Pat. No. 4,677,045 teaches the use of preferred binders for squarylium photogeneration dye molecules. U.S. Pat. No. 4,362,798 is exemplary of the use of hydrazones as hole transporting molecules of a photoconductor's charge transport layer (CTL). U.S. Pat. No.4,490,452 discusses the use of a preferred binder for use with amine dissolved charge generation dyes. In this example, the amine is used to not only dissolve the dye but also to act as a crosslinking specie for the epoxy resin binder.

U.S. Pat. No. 4,582,772 to Teuscher et al teaches polymerized bisphenol resins as a charge generation layer binder. Aluminum ground planes which are anodized on the side bearing a charge generation layer is an established alternative in this art. The present invention relates to the use of constituents of this type in conjunction with the use of molecular bisphenol molecules as binders in the amine solution deposited charge generation dye layer, thereby enhancing the stability of the charqe generation layer coating solution and the electrophotagraphic performance of the photoconductor.

BRIEF DESCRIPTION OF THE INVENTION

The invention provides a two layer, negatively charged, photoconductor whose binder is a noncrystalline mixture of bisphenol molecules. Such a binder is particularly suited to application by dip coating.

The advantages of such a system are manifold. When one attempts to coat a squarylium molecule from an amine solvent with no binder present the resultant coating quality and electrophotographic performance is poor.

Conventional high molecular weight polymeric materials which incorporate carbonyl or sulfonyl moieties are not stable to the corrosive amines used to dissolve the dye molecules and thereby adversely affect the stability of the charge generation coating solution. Binders which react with the amine solvents, such as the epoxies, are also unstable by reason of their reactivity. These systems can be used if mixed and coated immediately thereby limiting the formation of deleterious by-products or a change in the physical aspects of the coating solution (e.g. viscosity). A preferred resin for the squarylium/amine solution formulation has been the arylsulfonamide resins (Santolite MHP from Monsanto). When the charge generation formulation using this binder system is mixed, it must be used within 30 minutes in order to obtain proper coating quality and electrophotographic response.

Other high molecular weight binders which are stable in the amine solvents of choice have been shown to give either poor coating quality and/or poor electrophotographic response.

One advantage of the present invention is that an amine charge generation solution containing the molecular bisphenol binder additive has much improved stability over previous binder systems. This lends itself to being used in a dip coating process which is readily used in the industry for preparing photoconductor seamless drums for copiers and printers. A second advantage to the amine/dye molecular bisphenol binder system is that the solution is readily filtered through a 0.2 micron filter to minimize the presence of foreign contamination.

Another advantage to the present invention is the ability to obtain high quality and tinctorial strength coatings free from crystallization of the molecular binder specie which incorporates with and gives a preferred charge generation aggregate specie with the squarylium dye molecule. Aggregation is generally believed to be a short range order between molecules, allowing electronic transitions to occur between these molecules, giving rise to a much broadened absorption spectrum. These aggregates occur much more easily if the dye is locked in a planar structure. The binder can interact with the dye in such a way as to ensure that the proper dye morphology is obtained and also to ensure that optimum photogeneration occurs. The binder system herein disclosed is optimized to allow the generation molecule to perform at an improved level.

SPECIFIC DESCRIPTION OF APPLICATION OF THE INVENTION

The following examples are not to be considered limitations on the invention, many variations of which will be apparent to those of skill in this art without departing from the spirit or scope thereof. In these examples the ground plane is an aluminum drum or aluminum coated flexible support. Although a coated barrier layer as disclosed may foster noncrystallization of the bisphenol A-type binder, this invention is not limited or dependent on a coated barrier layer. A preferred implementation is an aluminum drum mechanically roughened to provide light scattering, anodized to a 10 micron layer with that layer coated directly with hydroxysquarylium and a 60% methyl bisphenol A and 40% bisphenol A to form a noncrystalline binder, with that layer coated with the charge transport layer. Such a mixture of bisphenols can be readily dip coated on the anodized drum.

Example 1

0.6 grams of 2,4-di-(ortho-hydroxy-p-dimethylaminophenyl) cyclobutene diylium-1,3-diolate (hydroxy squarylium or OHSQ) is dissolved in 4 cc of pyrrolidine. The solution is straw colored after complete dissolution of the dye molecule whereupon 5 cc of morpholine is added. This solution is then added to a solution containing 2.4 grams of binder (shown in table 1) in 50 cc of tetrahydrofuran. The resultant solution is coated on a meniscus coater to a thickness of about 0.025 mg/in squared on the aluminum surface of an aluminized Mylar polyester substrate. The coated article is cured for one hour at 100 degrees Centigrade.

During this curing process, the coating undergoes a shift in its visible color and in spectral absorption to the near infra red region of the spectrum.

A hole transport layer is now coated onto the aforementioned charge generation layer. This transport layer is coated from a solution of 9.5 grams of Merlon MPG-3408 polycarbonate (Mobay Chemical Company), 0.5 grams of the brand Vitel PE-200 polyester (Goodyear Tire and Rubber Company) and 8 grams of the hole transport molecule 1,1 diphenyl hydrazone of para diethylamino benzaldehyde (DEH) of which all had been dissolved in 100 cc of tetrahydrofuran. This coating is prepared by means of meniscus coating and after curing for one hour at 100 degrees Centigrade is on the order of 0.0015 cm thick.

TABLE 1

| Binder Comparison | | |
|---|---|---|
| Binder | Voltage (−675 grid) | Voltage (1.4 microjoules/cm squared) |
| #1 | −650 volts | −25 volts |
| #2 | −575 volts | −35 volts |
| #3 | −570 volts | −100 volts |
| #4 | −660 volts | −70 volts |
| #5 | −650 volts | −30 volts |

The following is a description of the binders evaluated. The energy supplied was from a solid state laser emitting at 820 nanometers.

1. 2,2-Bis(4-hydroxy-3-methylphenyl)propane (MBPA)
2. 4,4'-isopropylidenebis(2,6-dichlorophenol)
3. 4,4'-isopropylidenebis(2-(2,6-dibromophenoxy)-ethanol)
4. Bis(2-hydroxyphenyl) methane (2-OHPM)
5. Bis(4-hydroxyphenyl) methane It is obvious from the above data that the bisphenol structure has an effect on the electrical performance of the photoreceptor and that certain molecular structures will be preferred for their performance.

Example 2

Aluminized Mylar polyester was coated via meniscus coating with an amine impervious barrier layer consisting of 0.4% by weight Epoxy Resin Epon 1001 (Shell Oil Company) and 0.1% by weight Polyamide Resin Versamid 150 (General Mills) as crosslinker in 99.5 % by weight tetrahydrofuran. Coating thickness was 0.05 microns in thickness after curing for one hour at 100 degrees Centigrade. This material was then coated as in the previous example with the following charge generation material formulation. 0.6 grams of 2,4-di-(ortho-hydroxy-p-dimethylaminophenyl) cyclobutene diylium-1,3-diolate (hydroxy squarylium or OHSQ) is dissolved in 4 cc of pyrrolidine. The solution is straw colored after complete dissolution of the dye molecule whereupon 5 cc of morpholine is added. This solution is then added to a solution containing 2.4 grams of binder (shown in table 2) in 50 cc of tetrahydrofuran. The resultant solution is coated on a meniscus coater to a thickness of about 0.025 mg/in squared on the aluminum surface of an aluminized Mylar polyester substrate. The coated article is cured for one hour at 100 degrees Centigrade. During this curing process, the coating undergoes a shift in its visible color and in spectral absorption to the near infra red region of the spectrum. A hole transport layer is now coated onto the aforementioned charge generation layer. This transport layer is coated from a solution of 9.5 grams of Merlon MPG-3408 polycarbonate (Mobay Chemical Company), 0.5 grams of the brand Vitel PE-200 polyester (Goodyear Tire and Rubber Company) and 8 grams of the hole transport molecule 1,1 diphenyl hydrazone of para diethylamino benzaldehyde (DEH) of which all had been dissolved in 100 cc of tetrahydrofuran. This coating is prepared by means of meniscus coating and after curing for one hour at 100 degrees Centigrade is on the order of 0.0015 cm thick.

Coatings were made with the following binders when the solutions were fresh and then aged for 90 minutes and the electrophotographic data taken in example 1 was taken on these samples.

TABLE 2

| Binder/Aging Comparison | | |
|---|---|---|
| | Voltage (−675 grid) | Voltage (1.4 microjoules/cm squared) |
| Binder (fresh sol'n) | | |
| Bisphenol A | −650 volts | −50 volts |
| p-toluenesulfonamide | −545 volts | −45 volts |
| Binder (aged sol'n) | | |
| Bisphenol A | −635 volts | −35 volts |
| p-toluenesulfonamide | −530 volts | −75 volts |

The light energy supplied was again from a laser diode emitting at 820 nanometers. The aryl sulfonamide monomer is showing negative fatigue which is indicative of instability in the amine solvents used to dissolve the generating dye. This monomer is present in the polymeric binder of choice for amine/OHSQ charge generation systems (Santolite MHP made by Monsanto).

Example 3

Two charge generation solutions were prepared as illustrated in Example one. One of the charge generation solutions contained the binder bisphenol A (4,4'isopropylidene diphenol) and the other contained the binder Santolite MHP (aryl sulfonamide resin). Each solution was coated fresh and then stored under nitrogen and coated at various time intervals up to 1700 minutes (28 hours). The Voltage obtained with 1.4 microjoules/cm squared of 820 nanometer Energy was plotted as a function of time and the linear regression of the data gave the following equations.

For bisphenol A $y=0.021x+25$; y is the light voltage and x is the time in minutes. The correlation coefficient (r) was 0.984.

For Santolite MHP $y=0.28x+45$; y again is the light voltage and x again is the time in minutes. The correlation coefficient was 0.93.

This shows that the binder containing the sulfonyl moietie (Santolite MHP) is susceptible to more rapid solution aging which then gives deleteriously affected electrophotographic performance.

Example 4

Upon curing of the bisphenol containing charge generation layer crystals of the bisphenol material can form. This alters the coated uniformity of the photoreceptor which can give poor print quality. To eliminate this crystallization of the bisphenol molecule, mixtures of the MBPA (#1 in Example 1) and the bis-2-hydroxyphenylmethane were prepared with bisphenol A. The results are presented in Table 3.

TABLE 3

Crystallization (c) vs Amorphous (a) Generation Layers

| | Morphology |
|---|---|
| % PBPA in BPA | |
| 0 to 10% | crystals |
| 11 to 65% | amorphous |
| 66 to 100% | crystals |
| % 2-0HPM in BPA | |
| 0 to 45% | crystals |
| 46 to 90% | amorphous |
| 91 to 100% | crystals |

As evidenced from this morphology study, there is an operating space where crystallization is inhibited by mixing of bisphenol molecules.

Example 5

An Aluminum Core (3003 alloy) 40mm in diameter and 10 inches in length was used as the substrate for the photoconductors prepared in this example. The means of coating the layers which make up the photoreceptor is by dip coating. This method is similar to meniscus coating in that the viscosity of the coating solution and the speed of the drawing through the meniscus are the variables adjusted to give the proper coated weight.

The epoxy barrier layer used in example two was dip coated on the aluminum core to a coated weight after curing for one hour at 100 degrees Centigrade of 0.05 milligrams/in squared. The core with the barrier layer was then dip coated with a hydroxy squarylium charge generation solution comprising the following:

1. Tetrahydrofuran.....936 milliliters
2. 2,2 Bis(4-hydroxy-3-3methylphenyl) propane.....31.2 grams
3. Bisphenol A.....20.8 grams
4. OHSQ.....13 grams
5. Pyrrolidine.....95 milliliters
6. Morpholine.....101 milliliters The method of making this solution is to dissolve the bisphenol binder material in the tetrahydrofuran, dissolve the OHSQ in the pyrrolidine and then add the morpholine and then add the amine solution to the tetrahydrofuran solution. One obtains a greenish solution which is then filtered through a 0.2 micron filter. This solution is dip coated over the epoxy barrier layer to a coat weight, after curing for one hour at 100 degrees Centigrade, of about 0.045 mg/in squared.

The transport layer formulation as illustrated in example 2 is then used to overcoat the charge generation layer to a cured thickness of about 17 microns. Curing again is effected at 100 degrees Centigrade for one hour. Six photoreceptor drums were coated in such a fashion and then tested on an electrical tester which simulates the IBM 4019 Laserprinter. The dark voltage is measured by an electrostatic probe placed at the developer position and the light voltage is measured by the same probe after the photoreceptor drum has been exposed to 1.6 microjoules/cm squared of 780 nanometer radiation. The population parameters of the six drums are:

| Parameter | Dark Voltage | Light Voltage |
|---|---|---|
| Average | 855 | 111 |
| Stnd. dev. | 8.8 | 5 |

The six drums were then evaluated in an IBM 4019 Laserprinter for print quality and gave satisfactory prints.

Example 6

Two 3003 Aluminum cores, such as the ones used in Example 5, were anodized to a thickness of about 10 microns and were sealed using a conventional nickel acetate seal. One of the drums was coated, via dip coating, with the charge generation solution formulation described in Example 5 and the other drum was coated with the same formulation except that the arylsulfonamide resin Santolite MHP (Monsanto) was substituted for the bisphenol mixture. The application rate for both drums was 3 feet per minute and curing was for one hour at 100 degrees Centigrade. The transport layer coating was the same as used in the previous example.

The drums were then tested on the same electrostatic drum tester as the one in the previous example. The following Table summarizes the electrostatic measurement results.

TABLE 4

| Binder | Dark Volt | Res. @ 2 uj | E225 | Sens | Dv/dt | ODr | 2Kres |
|---|---|---|---|---|---|---|---|
| Santolite MHP | −766 | −52 | .68 | 832 | 29 | 1.65 | −150 |
| MBPA/BPA | −728 | −60 | .48 | 1100 | 33 | 2.15 | −80 |

All the results were obtained from the IBM LaserPrinter 4019 printer electrostatic drum tester. The columns can be explained as follows.

1. The dark voltage is the voltage on the drum at the developer probe position in the absence of the exposing light energy.
2. The Res@2uj is the voltage on the drum at the developer probe position when the drum is irradiated with 2 microjoules per centimeter squared of 780 nanometer radiation.
3. The E225 column is the energy in microjoules per centimeter squared at 780 nanometers required to decay the photoreceptor drum from the dark voltage to −225 volts.
4. The Sens column is a measurement of the sensitivity of the photoreceptor drum. It is calculated by subtracting the -225 volts from the Vdark and dividing by the E225. The larger the number the greater the sensitivity.
5. The Dv/dt is the dark decay in volts/second.
6. The ODr column is the reflectance optical density of the coated drum to the red portion of the visible spectrum. A MacBeth reflection densitometer using a wratten filter is used for making this measurement.
7. The 2Kres column is the voltage on the photoconductor after cycling for 2000 cycles with an exposure of 0.8 microjoules/cm squared using an exposure of 1.6 microjoules/cm squared to determine the voltage. It is used as a measurement of fatigue on the photoreceptor drum.

The data shows the advantages obtained when the bisphenol binder system is used in place of the arylsulfonamide binder.

Example 7

An aluminized Mylar polyester web was coated with a 0.005M $NaH_2PO_4$ (sodium phosphate monobasic) salt solution in deionized water. The web was cured for 10 minutes at 100 degrees Centigrade. The purpose of this salt treatment is to combine with Aluminum Lewis Acid surface states which induce low humidity dark decay in OHSQ generating layers. A charge generation layer formulation as in Example 1 is coated on the salt treated aluminized mylar surface and is then coated with the transport layer, again using the method described in Example 1. The resultant flexible web photoreceptor is then tested in an electrostatic tester simulating the IBM 3820 printer. An electrostatic probe is present in the developer position and is used to determine the voltage on the photoreceptor at the developer position. The table summarizes the electrostatic performance of this flexible web photoreceptor.

TABLE 5

| % RH | Dark Volt | Res. @ 1.4 uj | E225 | 2KDF | Dv/dt | 2KLF | 2Kres |
|---|---|---|---|---|---|---|---|
| <10% | −678 | −57 | .43 | 4 | 40 | −28 | −90 |

All the results were obtained from the 3820 printer electrostatic drum tester. The columns can be explained as follows.

1. The dark voltage is the voltage on the drum at the developer probe position in the absence of the exposing light energy.
2. The Res@1.4uj is the voltage on the drum at the developer probe position when the drum is irradiated with 1.4 microjoules per centimeter squared of 820 nanometer radiation.
3. The E225 column is the energy in microjoules per centimeter squared at 820 nanometers required to decay the photoreceptor drum from the dark voltage to −225 volts.
4. The 2KDF column is a measurement of the dark voltage fatigue of the photoreceptor drum. It is calculated by subtracting the dark voltaqe after 2K of cycling from the initial dark voltage. Cycling is accomplished with 0.8 microjoules/cm squared of laser energy.
5. The Dv/dt is the dark decay in volts/second after 2K of cycling.
6. The LF column is the difference in light potential observed with 0.8 microjoules/cm squared of laser energy from the beginning of the test to the end of the test.
7. The 2Kres column is the voltage on the photoconductor after cycling for 2000 cycles with an exposure of 0.8 microjoules/cm squared using an exposure of 0.8 microjoules/cm squared to determine the voltage. It is used as another measurement of fatigue on the photoreceptor drum.

Example 8

A flexible web photoreceptor was prepared as in Example 7 except that a 0.092 mg/in squared sublayer of polyvinylbutyral B-79 was coated on top of the salt treated aluminum. A similar web was prepared from the same aluminized Mylar polyester which was not salt treated. The solvent system for the polyvinyl butyral was 5 parts methanol and one part benzyl alcohol at 5% solids by weight. The coating technique utilized a 200 quad doctored gravure roll for application of the sublayer coating. The charge generation layer and charge transport layers were then coated as in Example one and the photoreceptors were evaluated on the IBM 3820 electrostatic tester.

TABLE 6

| Description | Dark Volt | Res. @ 1.4 uj | E225 | 2KDF | Dv/dt | 2KLF | 2Kres |
|---|---|---|---|---|---|---|---|
| Salt < 10% RH | −606 | −57 | .36 | 31 | 86 | −13 | −76 |
| Salt > 30% RH | −584 | −52 | .31 | −5 | 63 | −40 | −77 |
| noSalt < 10% RH | −585 | −69 | .37 | 72 | 194 | −18 | −94 |
| noSalt > 30% RH | −581 | −59 | .35 | 11 | 94 | −38 | −88 |

The effect of the salt treatment can be seen even when the bisphenol charge generation layer is used in conjunction with a polyvinylbutyral sublayer.

Example 9

Three coatings are made on aluminized Mylar polyester as described in Example 1. All coatings are prepared with the binder material MBPA (#1 in Example 1). Coating number 1 uses an aluminized Mylar polyester surface with no treatment prior to the application of the charge generation layer. Coating number 2 is subbed with a 0.05 micron Epon 1001 epoxy with the Versamid 150 crosslinking agent as described in Example 2. Coating number 3 was prepared by salt treating an aluminized Mylar polyester film and subbing it with Butvar B-79 (Polyvinylbutyral from Monsanto) as described in Example 8.

After coating the three aluminized webs with charge generation solution using only the MBPA as the binder material, the webs were cured at 100 degrees Centigrade for one hour and evaluated for the appearance of crystals in the charge generation layer. Table 7 gives the results of this evaluation.

TABLE 7

| Coating No. | Crystallization Evaluation: Crystallization | CG Receptive Layer |
|---|---|---|
| 1 | yes | aluminized mylar |
| 2 | yes | crosslinked epoxy |
| 3 | no | butyral sublayer |

This demonstrates that a mixed bisphenol charge generation solution is not necessary to avoid crystallization when the generation layer is being deposited on a layer which is attacked by the solvent system used in the generating dye formulation. However, the coating steps must be carefully controlled to avoid mixing, which tends to exclude dip coating. The receptive layer also gives the formulation chemist the opportunity to prepare very uniform, high quality coatings.

Coating number 3 was then coated with a charge transport layer as described in Example 1 and evaluated in an IBM 3820 electrostatic test apparatus (as in Example 7) obtaining the following electrostatic results.

TABLE 8

| % RH | Dark Volt | Res. @ 1.4 uj | E225 | 2KDF | Dv/dt | 2KLF | 2Kres |
|---|---|---|---|---|---|---|---|
| <10% | −678 | −57 | .43 | 4 | 40 | −28 | −90 |

This photoconductor would be satisfactory for use in an electrophotographic printer such as the IBM 3820 printer.

While the invention has been particularly shown and described with reference to preferred and illustrative embodiments thereof, it will be understood by those skilled in the art that various changes in form and details may be made therein without departing from the spirit and scope of the invention. In particular, while this invention does not require an organic coating between the ground plane and the charge generation layer, as established in Example 9, such a coating can foster noncrystallization and therefore may be an advantage in specific embodiments.

What is claimed is:

1. A xerographic photoreceptor, comprising; a ground plane member, a charge generation layer on said ground plane member comprising a squarylium charge generation molecule and a noncrystalline, nonpolymeric binder comprising a mixture of at least two materials selected from the group consisting of (1) bisphenol A, (2) methyl bisphenol A, (3) bis(2-hydroxy phenyl) methane and (4) bis(4-hydroxy phenyl) methane, and a charge transport layer on said charge generation layer.

2. The electrophotographic photoconductor of claim 1 where the ground plane member is an aluminum core with an anodized layer of about 3 to 18 micrometers thickness.

3. The electrophotographic photoconductor of claim 2 wherein said charge generating molecule is hydroxysquarylium and the binder material is 60% methyl bisphenol A and 40% bisphenol A, by weight.

4. The electrophotographic photoconductor of claim 1 wherein said charge generating molecule is hydroxysquarylium and the binder material is 60% methyl bisphenol A and 40% bisphenol A, by weight.

5. The electrophotographic photoconductor of claim 4 wherein said charge transport layer contains the hole transport molecule 1,1 diphenylhydrazone of para diethyaminobenzaldehyde.

6. The electrophotographic photoconductor of claim 3 wherein said charge transport layer contains the hole transport molecule 1,1 diphenylhydrazone of para diethyaminobenzaldehyde.

7. The electrophotographic photoconductor of claim 6 wherein said charge transport layer contains the hole transport molecule 1-phenyl-3-paradiethylaminostyryl-5-paradiethylaminophenyl-2-pyrazoline.

8. The electrophotographic photoconductor of claim 5 wherein said charge transport layer contains the hole transport molecule 1-phenyl-3-paradiethylaminostyryl-5-paradiethylaminophenyl-2-pyrazoline.

9. A xerographic photoreceptor, comprising: an aluminum ground plane member anodized on one side, a charge generation layer on said one side of ground plane member comprising a squarylium charge generation molecule and a noncrystalline, nonpolymeric binder comprising a mixture of at least two materials selected from the group consisting of (1) bisphenol A, (2) methyl bisphenol A, (3) bis(2-hydroxy phenyl) methane and (4) bis(4-hydroxy phenyl) methane, and a charge transport layer on said charge generation layer.

10. The electrophotographic photoconductor of claim 9 wherein said charge generating molecule is hydroxysquarylium and the binder material is 60% methyl bisphenol A and 40% bisphenol A.

* * * * *